United States Patent [19]

Patrick

[11] 4,044,436

[45] Aug. 30, 1977

[54] CASKET SUSPENSION

[75] Inventor: John H. Patrick, Carthage, Mo.

[73] Assignee: Flex-O-Lators, Inc., Carthage, Mo.

[21] Appl. No.: 681,169

[22] Filed: Apr. 28, 1976

[51] Int. Cl.[2] ..... A61G 17/00

[52] U.S. Cl. ..... 27/12

[58] Field of Search ..... 27/12, 13, 28, 2; 5/328; 248/290, 294, 295, 407

[56] References Cited

U.S. PATENT DOCUMENTS

| | | | |
|---|---|---|---|
| 771,729 | 10/1904 | Hooker et al. | 27/12 |
| 985,512 | 2/1911 | Coughlin | 27/13 |
| 2,142,553 | 1/1939 | Benoit | 27/12 |
| 2,238,774 | 4/1941 | Hopkes | 27/12 |
| 2,449,424 | 9/1948 | Stieber | 27/12 |
| 2,470,321 | 5/1949 | Reese et al. | 27/12 |
| 3,065,516 | 11/1962 | Dower | 27/12 |
| 3,300,828 | 1/1967 | Hegman et al. | 27/12 |
| 3,692,267 | 9/1972 | Kronas et al. | 27/12 |

FOREIGN PATENT DOCUMENTS

| | | | |
|---|---|---|---|
| 491,846 | 2/1919 | France | 27/12 |

*Primary Examiner*—John D. Yasko
*Attorney, Agent, or Firm*—John A. Hamilton

[57] ABSTRACT

A device for suspending bodies in caskets consisting of a sheet of flexible wire fabric adapted to be disposed generally horizontally in a casket and to cover substantially the entire internal area thereof; and a series of hanger brackets arranged along each interior side of the casket and affixed therein, each edge of the fabric being securable to each of the brackets at selected, vertically spaced apart points, so that the contour of the fabric may be adjusted to display the body neatly and attractively despite variations in the thickness, bulk, and conformation thereof.

4 Claims, 4 Drawing Figures

CASKET SUSPENSION

Figure 1:
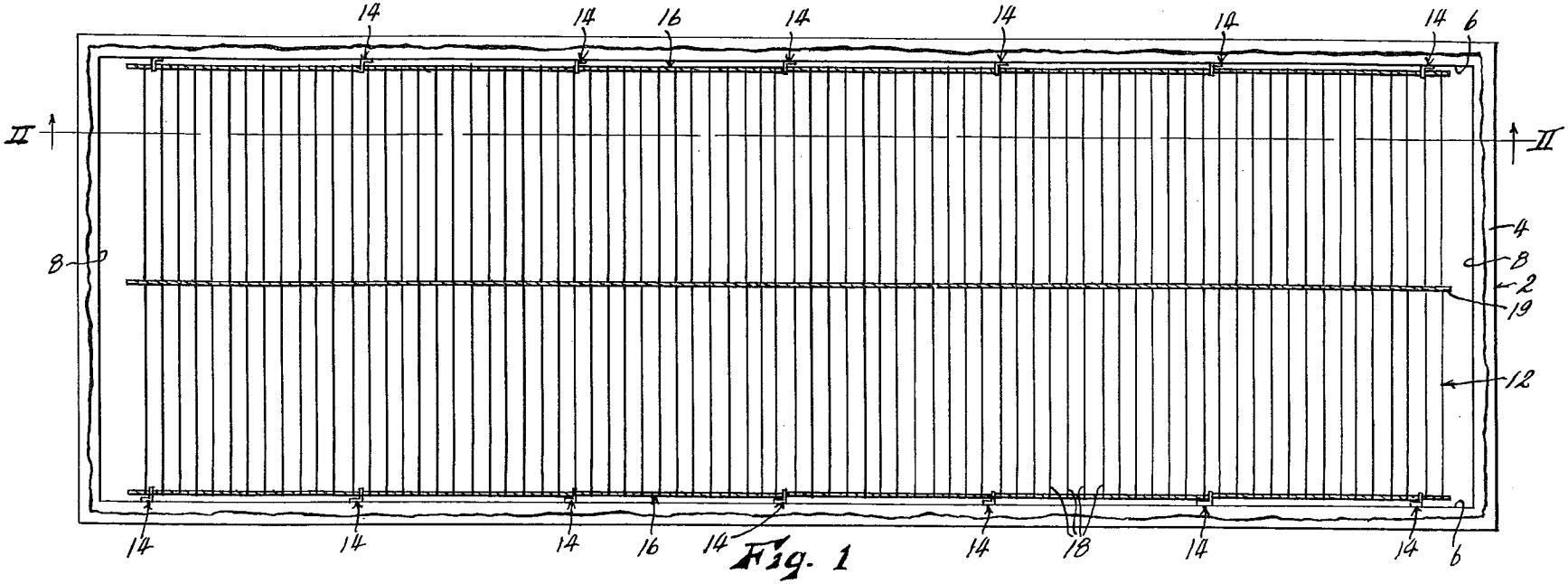

This invention relates to new and useful improvements in caskets, and has particular reference to an improved device for supporting a body within a casket.

In most cases, it is desired that a deceased person should "lie in state" in his casket for a period of time preceding his actual funeral services, with the casket open and his body open to view if possible. This requires that the body be disposed evenly at the top of the casket body or box portion, at a rather precise elevation relative thereto. This can be a rather difficult operation, due to normal variations in vertical thicknesses of different bodies, requiring that different bodies be suspended at different elevations in the casket body. Variations in the thickness of a single body, such as heavy hips or a large stomach, often render it desirable that the suspension surface be non-planar, in order that the top surface of the body will appear more normally at rest. Permanent malformations of a body may render still further variations in the elevation and contour of the suspension surface necessary or desirable. In some cases, the bottom of the casket is partially filled with wadded newspaper, excelsior, cellulose pads, or other loose packing material, which may be built up to the desired elevation, hollowed out in some areas to provide a body supporting surface having the necessary elevation and contour to support nearly any body in the desired attitude, but this is a difficult, tedious, time-consuming operation requiring a considerable degree of skill. Some caskets include a body suspension in the nature of a steel mesh wire cot, but many of these include no means for adjusting their elevation within the casket, and all of them within my knowledge provide essentially planar support surfaces, which for the reasons given above are incapable of supporting some bodies in the desired attitude of repose. Some "cot" type suspensions may be provided with means for adjusting the elevation of the suspensions, and for tilting it from horizontal, but these are at best only partial solutions to the problem, since the body supporting surfaces of the suspensions remain essentially planar.

Accordingly, the principal object of the present invention is the provision of a body support for use in caskets which solves the above described problem in most cases, allowing nearly any body to be supported neatly and attractively in the desired attitude of repose.

Generally, this object is accomplished by the provision of a flexible deck sheet adapted to be disposed within the casket box, covering substantially the entire area thereof and spaced above its bottom, and means operable to support said deck sheet, said support means being adjustable, as permitted by the flexibility of the deck sheet, to support said deck sheet at different elevations and in any of many different vertical configurations, as necessitated by the contour of the body to be supported.

Another object is the provision of a casket suspension of the character described wherein said support means includes a series of support brackets fixed in the casket box and distributed along the sides of the deck sheet, the deck sheet being engageable selectively to each of said brackets at any one of a series of vertically spaced apart points whereby the elevation and the vertical contour of the flexible deck sheet may be variably adjusted.

Other objects are simplicity and economy of construction, and efficiency and dependability of operation.

Figure 2:
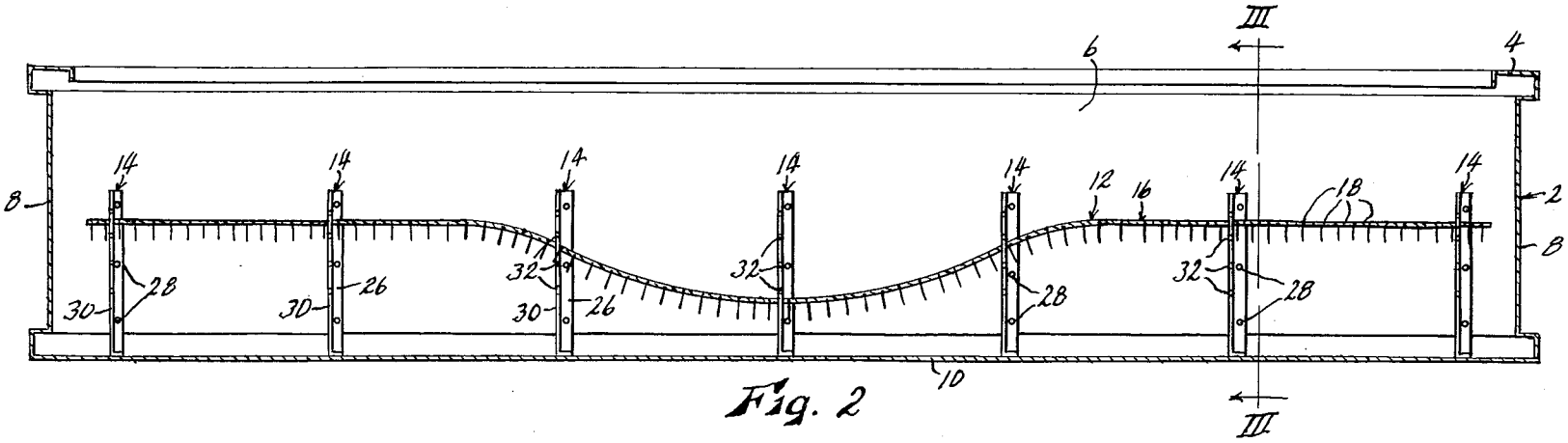
Figure 4:
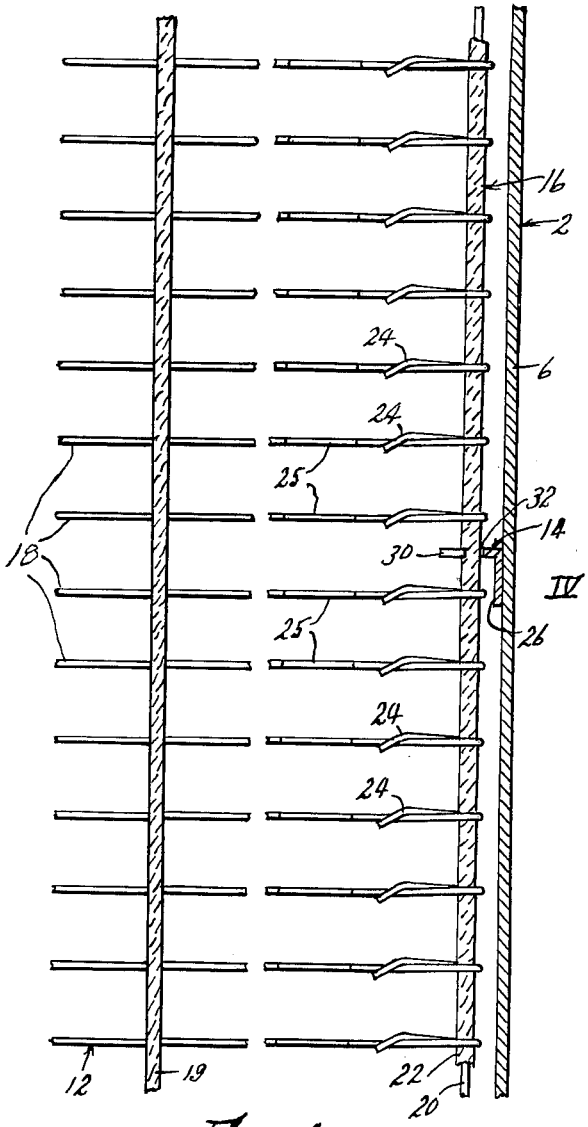
Figure 3:
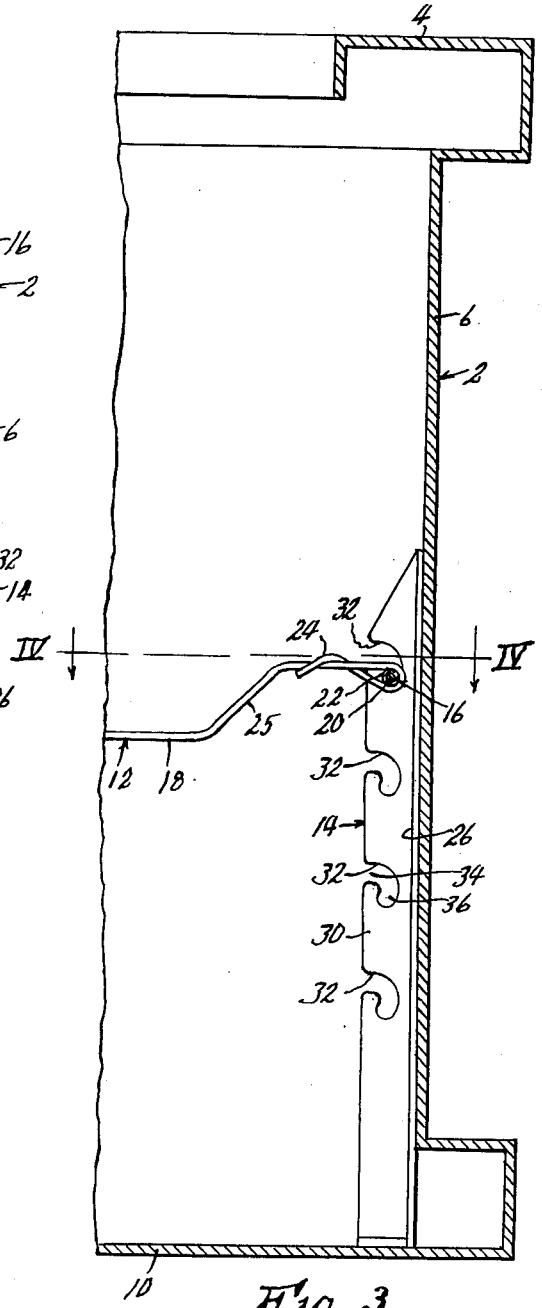

With these objects in view, as well as other objects which will appear in the course of the specification, reference will be had to the accompanying drawing, wherein:

FIG. 1 is a top plan view of the lower or box portion of a casket, showing a body suspension embodying the present invention operatively mounted therein, a portion of the top lip of the casket box being broken away, FIG. 2 is a sectional view taken on line II—II of FIG. 1, showing one possible vertical configuration of the deck sheet, FIG. 3 is an enlarged, fragmentary sectional view taken on line III—III of FIG. 2, and FIG. 4 is a fragmentary sectional view taken on line IV—IV of FIG. 3.

Like reference numerals apply to similar parts throughout the several views, and the numeral 2 applies generally to the box or body portion of a casket, shown without its cover or lid. Said box is of elongated rectilinear form, opening upwardly, being formed of sheet metal, wood or other suitable material, and is provided around the entire periphery of its upper edge with an inturned lip 4. It includes vertical parallel side walls 6, end walls 8, and a bottom or floor 10.

The body suspension forming the subject matter of the present invention includes a deck sheet 12 and mounting brackets 14 for said deck sheet. Deck sheet 12 consists of a resiliently flexible wire fabric, rectangular in form and of a size to substantially cover the internal horizontal area of box 2. It consists of a pair of side strands 16 which are substantially parallel and extend along the interior surfaces of box side walls 6, a continuous series of parallel cross wires 18 extending transversely between side strands 16 and securely affixed thereto, and one or more intermediate strands 19 extending parallel to the side strands, in regularly spaced relation therebetween, and connected to all of said cross strands. As best shown in FIG. 3, each side strand 16 consists of a spring wire core 20, covered by a sheath 22 of soft, indentable material such as twisted paper or the like. Cross wires 18 are also formed of spring metal, and are spaced sufficiently closely together to define, in skeleton form, a deck of adequate continuity to support a body thereon. Each cross wire is wrapped tightly about the sheath 22 of each side strand, and then twisted on itself as indicated at 24 to form a "knot" which will not pull loose in normal usage. Intermediate strands 19 (one shown) serve to maintain the proper spacing of cross wires 18 throughout their lengths, and are preferably formed of a soft, pliably flexible material such as twisted paper, pierced by each cross wire 18 at its point of intersection therewith. Each cross wire 18 is provided, adjacent each side strand 16, with a downward offset 25, as best shown in FIG. 3.

Each bracket 14 is of elongated form, being formed of sheet metal and of angular cross-sectional contour. A series of said brackets are spaced regularly along each side of the casket box, interiorly thereof, as best shown in FIGS. 1 and 2. Said brackets are disposed vertically, one of the angular legs 26 of each bracket lying flat against the adjacent side wall 6 of the casket and being spot welded or otherwise rigidly affixed to said side wall as indicated at 28, and the other angular leg 30 projecting into the interior of the casket. Preferably, the lower end of each bracket is based solidly on the floor 10 of the casket for still better support. A series of notches 32 are formed in the free edge portion of leg 30 of each bracket, said notches being regularly spaced apart vertically of said bracket. As best shown in FIG. 3, each notch 32 is generally L-shaped, having a generally horizontal top leg 34 opening through the free edge of bracket leg 30, and a generally vertical leg 36 extending downwardly from the inner end of leg 34. Vertical leg 36 is angled downwardly toward the free edge of bracket leg 30.

Deck sheet 12 is mounted in the casket box by snapping side strands 16 of said deck sheet outwardly and downwardly into selected notches 32 of brackets 14, as shown. By selecting different notches of the respective opposite pairs of brackets, both the elevation and the longitudinal vertical contour of the deck sheet may be variably adjusted at will, an example of such vertical configuration being illustrated in FIG. 2. In this manner, the deck sheet may be so configurated as to support a body of nearly any size or configuration neatly and attractively as possible for display while "lying in state." It will of course be understood that padding will ordinarily be applied over the deck sheet, as well as cover sheets and casket lining material of decorative fabric. However, these layers in themselves form no intrinsic part of the present invention, and they are not shown.

The configuration of notches 32 prevents side strands 16 from being dislodged therefrom by the weight of a body supported by the deck sheet, since the downward and inward slope of the vertical legs 36 of the notches causes said weight to draw the side strands firmly to the bottom ends of said vertical notch legs. Deck sheet 12 is flexible transversely of its plane, by virtue of the flexibility of both its cross wires 18 and the core wires 20 of its side strands, and hence it can be freely configurated as shown and described, and is resiliently stretchable transversely of the casket, by reason of offsets 25 of wires 18. The soft, indentable sheaths 22 of core wires 20 of the side strands have the function of preventing any possible metallic grating or rubbing noises, which would of course be highly objectionable, either at the connections of cross wires 18 to the side strands, or at the connections of said side strands to brackets 14. The outward displacement of side strands 16, as provided by offsets 25, is sufficient to permit said side strands to be "snapped" into the vertical legs 36 of the bracket notches, with the elastic recovery of wires 18 serving to pull strands 16 to the lower ends of inclined notch legs 36 and retain them in that position. This action will occur so long as the width of the deck sheet is tailored to the width of the casket. In some cases it may be desirable to engage corresponding laterally opposite points of the sheet at vertically different points of the corresponding brackets 14. In this manner, the deck sheet, or portions of it, may be tilted laterally, as well as longitudinally configurated as previously described. Such lateral tilting may be useful in properly supporting bodies having certain types of configurations or malformations. The offsets 25 of wires 18 allow enough lateral tilting of the deck to permit this type of adjustment.

While I have shown and described a specific embodiment of my invention, it will be readily apparent that many minor changes of structure and operation could be made without departing from the spirit of the invention.

What I claim as new and desire to protect by Letters Patent is:

1. A device for suspending a body in a casket, said device comprising:

a. a series of brackets fixed to the interior surface of said casket in spaced relation along substantially the entire length of said casket along each side of said casket, each of said brackets comprising a vertically disposed member projecting inwardly from the casket side to which it is affixed, and having a series of vertically spaced apart notches formed therein, each of said notches opening through the inner edge of said vertical bracket member, and extending outwardly and then downwardly from said opening, the downwardly extending portion of each of said bracket notches being inclined downwardly and inwardly relative to said casket, and b. a deck sheet flexible transversely of its plane and of sufficient area to cover substantially the entire interior horizontal area of said casket, said deck sheet including a pair of flexible side strands disposed respectively along the opposite sides thereof and each engageable in any selected notch of each bracket at the corresponding side of the casket, whereby said deck sheet is supported, said side strand being insertable, transversely of itself, outwardly and downwardly into said notch, the width of said deck sheet being such that its side strands are normally spaced apart less than the distance between the lower ends of the downwardly extending notch portions of brackets at opposite sides of the casket, said deck sheet being laterally resiliently strechable, whereby said side strands may be engaged in said notches, whereupon the lateral resilience of said deck sheet urges the side strands thereof to the lower ends of said downwardly extending notch portions.

2. A device as recited in claim 1 wherein said deck sheet comprises said flexible side strands and a continuous series of closely spaced apart, parallel cross wires extending transversely between and secured at their ends to said side strands.

3. A device as recited in claim 2 wherein said side strands and said cross wires are resiliently flexible, and wherein each of said cross wires has offsets formed therein.

4. A device as recited in claim 2 wherein each of said side strands comprises a core of spring steel wire having a sheath of soft, indentable material, and wherein each of said cross wires is also formed of spring steel and is knotted at its ends around the sheaths of said side strands, said sheaths preventing metallic rubbing or grating noises both at the connections of said cross wires to said side strands, and also at the connections of said side strands to said brackets.

* * * * *